US011939739B2

(12) United States Patent
Westergaard et al.

(10) Patent No.: US 11,939,739 B2
(45) Date of Patent: Mar. 26, 2024

(54) HYDRAULIC ARRANGEMENT

(71) Applicant: Danfoss Power Solutions Inc., Ames, IA (US)

(72) Inventors: Erik Westergaard, Nordborg (DK); Henrik Hauge, Nordborg (DK)

(73) Assignee: DANFOSS POWER SOLUTIONS INC., Ames, IA (US)

( * ) Notice: Subject to any disclaimer, the term of this patent is extended or adjusted under 35 U.S.C. 154(b) by 413 days.

(21) Appl. No.: 17/226,303

(22) Filed: Apr. 9, 2021

(65) Prior Publication Data

US 2021/0317638 A1 Oct. 14, 2021

(30) Foreign Application Priority Data

Apr. 14, 2020 (DE) ..... 102020110187.2

(51) Int. Cl.
*E02F 3/34* (2006.01)
*E02F 3/43* (2006.01)
(Continued)

(52) U.S. Cl.
CPC ..... *E02F 3/3411* (2013.01); *E02F 3/432* (2013.01); *E02F 9/2029* (2013.01);
(Continued)

(58) Field of Classification Search
CPC ..... E02F 3/3411; E02F 3/432; E02F 3/433; E02F 9/2029; E02F 9/2203; E02F 9/2221
See application file for complete search history.

(56) References Cited

U.S. PATENT DOCUMENTS 3,896,951 A * 7/1975 Seaberg ..... E02F 3/433 414/815
4,364,705 A * 12/1982 Shumaker ..... E02F 3/3411 414/706
(Continued)

FOREIGN PATENT DOCUMENTS

CN 1651666 A 8/2005
CN 102829008 A 12/2012
(Continued)

OTHER PUBLICATIONS

First Office Action for Chinese Patent Application No. 202110403069.9 dated Jul. 15, 2022 and its English translation.

*Primary Examiner* — Michael Leslie
(74) *Attorney, Agent, or Firm* — McCormick, Paulding & Huber PLLC

(57) ABSTRACT

The invention relates to a method (19) of operating a hydraulic arrangement (1) including a mounting base (5), a boom (3) that is pivotably arranged on the mounting base (5), and a Z-kinematics (2) that is arranged on the boom (3). The Z-kinematics (2) tilts a tool attachment device (10), that is pivotably arranged on the boom (3). The boom (3) is moved by a lifting hydraulic piston (7) that is connected to the boom (3) and to the mounting base (5). The Z-kinematics (2) is moved by at least a tilting hydraulic piston (11) that is connected to a lever of the Z-kinematics (2) and to the mounting base (5). On application of an input control command for changing the position of the lifting hydraulic piston (7), a compensation command is automatically generated and applied to the tilting hydraulic piston (11), to essentially maintain the attitude of the tool attachment device (10). The compensation command is generated based
(Continued)

on the input control command for the lifting hydraulic piston (7), using a mathematical model of the hydraulic arrangement (1).

20 Claims, 5 Drawing Sheets

(51) Int. Cl.
*E02F 9/20* (2006.01)
*E02F 9/22* (2006.01)

(52) U.S. Cl.
CPC ..... *E02F 9/2203* (2013.01); *E02F 9/2228* (2013.01); *E02F 9/2296* (2013.01)

(56) References Cited

U.S. PATENT DOCUMENTS 5,156,520 A * 10/1992 Ericson ..... E02F 3/433 414/710
5,201,235 A * 4/1993 Sutton ..... F16H 21/04 74/105
6,233,511 B1 5/2001 Berger et al.
6,309,171 B1 10/2001 Arck et al.
6,763,619 B2 7/2004 Hendron et al.
8,662,816 B2 * 3/2014 Grimes ..... E02F 3/96 414/700
9,822,507 B2 11/2017 Singh et al.
10,633,819 B2 * 4/2020 Zhao ..... E02F 3/3411
2005/0211449 A1 9/2005 Bares et al.
2014/0107841 A1 4/2014 Danko

FOREIGN PATENT DOCUMENTS

CN 103328730 A 9/2013
CN 104471151 A 3/2015
CN 106436791 A 7/2017
CN 107023045 A 8/2017
CN 108713081 A 10/2018
CN 110088406 A 8/2019
NL 1008432 C2 * 8/1999 ..... E02F 3/3411

* cited by examiner

HYDRAULIC ARRANGEMENT

CROSS-REFERENCE TO RELATED APPLICATION

This application claims foreign priority benefits under 35 U.S.C. § 119 to German Patent Application No. 102020110187.2 filed on Apr. 14, 2020, the content of which is hereby incorporated by reference in its entirety.

TECHNICAL FIELD

The invention relates to a method of operating a hydraulic arrangement comprising a Z-kinematics. Furthermore, the invention relates to a controller device, to a hydraulic arrangement and to a working vehicle.

BACKGROUND

Whenever bulk material is to be handled in huge quantities, in particular in mines, construction sites, quarries, agriculture and storage sites using huge piles (just to name some examples), telescopic handlers, telehandlers, telescopic wheel loaders, wheel loaders and the like are widely employed types of machinery. In particular, they can be used without any major infrastructure. Therefore, they can be used much more flexible and in areas, where fixed constructions like gantry cranes, big hoppers, underground bunkers or the like are not sensible to be used—despite of their intrinsic advantages.

The very basic structure of such telescopic handlers, telescopic wheel loaders, and general wheel loaders is that they have a movable vehicle chassis on wheels and sometimes on crawler chains. Attached to the vehicle chassis is an arrangement of levers and booms that is pivotably attached to the vehicle chassis. Typically, the arrangement of levers is operated using hydraulic pistons, albeit in principle different actuators can be used as well. A movement of the lifting hydraulic piston(s) results in upward and downward movement of those parts of the arrangement of levers that are attached to the boom opposite of the hinge point. Here, usually tiltable devices are attached, like a shovel, a bucket, a fork or the like. By tilting the shovel/bucket/fork (or different device), the material to be moved can be either held inside/held at the device in a way that a movement of the vehicle is possible without losing the goods, or in a way that the goods are released. As an example, in case of a bucket, the bucket can be placed in a recess-like position so that gravel or other types of solid bulk freight can be moved around. By tilting the bucket, the gravel can be poured out at its destination place. This can be a truck, a lorry, a railroad car, a pile of solid bulk freight and/or the like. It is needless to say that such vehicles are very widespread and are employed successfully in a wide area of technical fields. Consequently, the production of such machinery is an interesting economical field.

However, standard machinery requires well-trained operators. The problem is that due to the design and arrangement of the machine, the actuation of the various hydraulic pistons does not only have the desired influence on the directly actuated parts of the machinery, in particular of the main boom or the like. Instead, usually side effects, causing different and undesired types of movement can be observed. So far, these side-effects have to be either tolerated and/or have to be compensated by an appropriate manual actuation of the machinery by well skilled personnel.

To give an example: if the bucket of a telehandler has to be raised, this is done by actuating lifting hydraulic pistons, which will result in lifting or lowering of the main boom (to be exact: lifting or lowering of the parts of the main boom that are positioned opposite of its hinge point) of the telehandler. However, since the main boom is pivotably arranged at the vehicle chassis, the lifting hydraulic pistons will not only result in a lifting and lowering of the boom, and hence of the devices that are attached thereto (possibly of the bucket), but instead the lifting/lowering of the boom will also result in a certain tilting movement of the bucket. In particular, in case of larger height changes, this can result in a spill of the goods that are contained in the bucket. Certainly, this is not desired. Even worse, if goods are transported on the fork of a telehandler (to give another example), it is even possible that the goods that are stored on a pallet that is moved by such a telehandler may fall off the fork and/or off the pellet.

With standard equipment, the operator of the telehandler (or other type of machinery) has to keep these side-effect movements in mind, and has to compensate for them by appropriately actuating an appropriate compensating tilting actuation of the bucket/fork/shovel or the like.

It is clear that such an orchestrated application of various settings of different levers and pedals is not an easy task to do and requires sufficient training and sufficient experience by the operator. Even then, the operator is prone to exhaustion after comparatively short time spans. Also, even well-trained operators do make erroneous input, which can lead to a spill of bulk goods, to give an example.

In the prior art, various suggestions were already made to address this issue for the operators of such machinery.

As an example, U.S. Pat. No. 6,233,511 B1 suggests to use an electronic digital controller in connection with a loader that includes conventional mechanical components. The hydraulic valves are electronically controlled in a way that when the operator commands to raise or lower the bucket of the tractor, the controller rolls the bucket in a way to maintain a substantially constant angle between the bucket and the loader's frame (i.e. to maintain a constant attitude of the bucket). U.S. Pat. No. 9,822,507 B2 and 6,763,619 B2 follow a similar approach. However, the present solutions are limited to certain types of kinematics, like P-kinematics.

A problem with the limitation to P-kinematics (or possibly other types of kinematics) as opposed to Z-kinematics is that due to the law of the lever, a certain force that is exerted by the tilting hydraulic piston is transmitted to the bucket/shovel/fork without any amplification. Further, those kinematics usually require more space, as opposed to Z-kinematics. All of these are non-negligible disadvantages.

An applications of the "automatic compensation idea" (as suggested in U.S. Pat. No. 6,233,511 B1, 9,822,507 B2 and 6,763,619 B2, for example) was never made so far for Z-kinematics, possibly because of the more complicated, and in particular ambiguous modelling of the moving behaviour of at least some designs of Z-kinematics.

Another aspect why an application of the "automatic compensation idea" was never made so far for Z-kinematics might lie in the fact that some designs of Z-kinematics do show a certain tendency to partially maintain the attitude of the tool attachment device on varying the boom. Therefore, the current approach was to use such special designs of Z-kinematics, in case of need of an automatic compensation behaviour.

These and other problems can be solved when employing the present idea.

SUMMARY

It is therefore an object of the present application to suggest a method of operating a hydraulic arrangement comprising a Z-kinematics that is arranged on a boom in a way that the method is improved over previously known methods of operating a hydraulic arrangement of this type. It is another object of the present invention to suggest a controller device that is improved over controller devices that are known in the state of the art. Yet another object of the invention is to suggest a hydraulic arrangement that is improved over hydraulic arrangements that are known in the state of the art. Even another object of the present invention is to suggest a working vehicle that is improved over working vehicles that are known in the state of the art.

It is therefore suggested to employ a method of operating a hydraulic arrangement comprising a mounting base, a boom that is pivotably arranged on the mounting base, a Z-kinematics that is arranged on the boom, where the Z-kinematics is designed and arranged to tilt a tool attachment device, the tool attachment device being pivotably arranged on the boom in a way that the boom is moved by at least a lifting hydraulic piston that is connected to the boom and to the mounting base, wherein the Z-kinematics is moved by at least a tilting hydraulic piston that is connected to a lever of the Z-kinematics and to the mounting base. On application of an input control command for changing the position of the lifting hydraulic piston, a compensation command is automatically generated and applied to the tilting hydraulic piston, to essentially maintain the attitude of the tool attachment device, where the compensation command is generated based on the input control command for the lifting hydraulic piston, using a mathematical model of the hydraulic arrangement. The Z-kinematics, as presently proposed, has the advantage that the actuating force of the respective hydraulic piston can usually be amplified (or at least remain constant), thanks to the law of levers. This way, the respective hydraulic piston can be made smaller, the hydraulic oil pressure can be smaller, the tilting force of the shovel/bucket/fork (or the tool attachment device for attachment of such or a different tool) can be made large, the backfiring force of the tool to the hydraulic piston can be reduced (for example, if shovel is pushed into a pile of comparatively large rocks by a forward movement of a telehandler, or the like). Furthermore, normally the required mounting space for Z-kinematics also does show certain advantages. Typically, the Z-kinematics is designed in a way that a rocking lever is rotatably arranged on the mounting device. The rotatable mount is usually placed in a somewhat middle section of the rocking lever. Usually, the mounting base for the rocking lever is a boom, while the boom is usually pivotably arranged on a vehicle chassis, or like. However, a different type of attachment and/or a different mounting base for the Z-kinematics is possible, in principle, as well. The tilting hydraulic piston, whose main objective is to move the various parts of the Z-kinematics and hence the tool attachment device and ultimately the finally attached tool (possibly including the goods that are loaded thereon), is usually attached to a first end section of a rocking lever, on one side, while it is pivotably attached to the mounting base of the hydraulic arrangement on its other end (typically a vehicle chassis). The second end section of the rocking lever (opposite side of the first end section with respect to the rotating point) usually connects directly or indirectly (i.e. possibly using another lever-like means) to the tool attachment device and/or the attached tool. By choosing an appropriate ratio for the distances of the respective end sections to the respective rotating point (length of the respective parts of the rocking lever), an appropriate amplification of the actuating force (if any) can be easily achieved. The boom, which is pivotably arranged on the mounting base (like a vehicle chassis or the like) is actuated by a lifting hydraulic piston that is connected with one of its sides to the boom and with its opposite side to the mounting base (like a vehicle chassis). Its principal purpose is an upward and downward movement of the tool attachment device/the attached tool. However, due to the usually pivotable attachment of the boom to its mounting base, an unintended additional movement (a side-effect movement, so to say) is usually induced as well, at least for certain ranges of positions of the boom. Namely, an upward and downward movement of the boom will typically also result in a certain forward and backward movement of the tool attachment device/the attached tool. Additionally and/or alternatively, an upward and downward movement of the boom will usually also result in a certain change of attitude, i.e. a certain rotational movement of the tool attachment device/attached tool, if no special compensating means are foreseen. As presently proposed, such a compensation with respect to the tool's attitude is automatically performed, when an upward/downward movement of the boom is commanded by an operator. The compensation of the attitude can be done, at least in part, mechanically and/or logically. Typically, a (mainly) logical compensation is preferred, where a logical compensation means that a controller device or a similar device will automatically apply an appropriate rotational compensation by applying an appropriate control command for the tilting hydraulic piston, when the operator commands an upward/downward movement of the boom. This way, the operation of the arrangement can be simplified, additional work by an unintentional spill of goods to be transported can be avoided, and possibly even accidents can be avoided, that may be caused by falling goods. Instead of talking about a mechanical compensation and/or a logical compensation, one might talk about a passive compensation and an active compensation, respectively, as well. This is because a compensation based on the mechanical design compensates by virtue of its fundamental mechanical behaviour, i.e. passively. On the other hand, when logic is used to apply a suitable compensation, this means that a corrective signal is calculated and applied actively to the actuators, hence active compensation. The compensation is at least partly performed using a mathematical model of the hydraulic arrangement. The model can be preferably implemented when manufacturing the arrangement, e.g. at a manufacturing factory. Using the present position of the arrangement, an (electronic) controller can be used to automatically calculate that a certain commanded action of an upward/downward movement will require a certain corrective actuation of the tilting hydraulic piston, based on a mathematical model/on geometrical considerations that may be the foundation of the mathematical model employed. Admittedly, the corrective action may not be perfect from an academic viewpoint, i.e. it is possible that despite of the corrections, a certain, usually significantly reduced rotation of the tool attachment device/the attached tool might nevertheless occur (under normal operating conditions, this will be on a minuscule level). However, the advantage of the presently proposed idea to use a correction that is based on a mathematical model is that it is fast and no time lag occurs (which might happen if first a sensor signal/an angle signal/a position signal has to be read in, interpreted, and consequently a corrective actuation will be calculated and finally be commanded).

For the sake of completeness, it should be noted that, depending on the forces, the arrangement is designed to cope with, a single device, two devices, three devices, four devices or even more devices of the respective type might be present. As an example, it is possible that a single boom (a single pole) is present. If larger geometries and/or forces are to be handled, two booms might be used (which is actually the typical number for booms). In case of very high loads, even three or four booms might be envisaged. The respective devices may or may not be interconnected with each other, for example, in a truss-like way. The aforesaid does not only apply for passive parts (rod/rocking lever, tool, attachment device etc.), but also for active parts, like hydraulic pistons or the like.

Preferably, the method is applied for a hydraulic arrangement, in particular a hydraulic arrangement, comprising a Z-kinematics that is operated on different sides of a dead centre position of the respective device (hydraulic arrangement, Z-kinematics, etc.), preferably across the dead centre position thereof. Certain parts of certain devices, in particular the connection between a rocking lever and a connecting lever (the connecting lever typically connecting an end section of the rocking lever with an appropriate part of the tool attachment device and/or the tool), will show a so-called dead centre. One can understand this in a way that a movement of the respective device in a certain rotational direction will cause the connected device to sort of move back and forth, i.e. to first move in a certain translational direction, to stop with respect to this direction and to reverse its direction of movement in this direction, when the rotational movement continues. For completeness, it has to be noted that usually the translational movement in the first direction is regularly (although not necessarily) superimposed with a second direction of translational movement (usually not reversing its direction). Typically, however, near the dead centre position, the speed of movement in this second direction is typically essentially constant. Further, the first and second directions of movement are typically perpendicular to each other. Alternatively, one might talk about a "reversal point" or a most distant/closest point (in particular when seen from a certain reference point/line/plane, like a main boom), in particular of a certain connection point/connection axis/pivoting point/pivoting axis (or the like) exists between two pivotally connected parts. In particular, this pivoting point (or similar expression) might be the pivotally movable connection point between a connecting lever and a rocking lever of the Z-kinematics. The similarity of the kinematical movement of the connection point and/or the respective parts on one hand and a crankshaft and a connecting piston rod/connecting rod on the other hand is obvious to a person skilled in the art. The described situation is very likely to occur in Z-hydraulic kinematics, due to the mechanical setup of the respective parts. This design is even particularly advantageous, since typically around the dead centre position, the imposable/translatable forces are usually particularly large. Furthermore, when a Z-kinematics is operated across and/or around its dead centre position, the respective Z-kinematics can typically be designed particularly compact, which is advantageous as well.

It is also suggested to apply the method for operating a hydraulic arrangement, in particular a hydraulic arrangement comprising a Z-kinematics, in a way that the Z-kinematics is operated in a way that a first connecting point of parts of the Z-kinematics may be moved across and/or may be operated on both sides of a straight line that is defined by a second and third connecting point of parts of the Z-kinematics. Instead of a connecting point, one could also talk about a connecting axle, a pivoting point, a pivoting axle and like. The parts that are connected by means of by a first, second and/or third connecting point may be different or partially fall together. In particular, first and second/third connecting point might have a part in common. In particular, this part may be the tool attachment device. More particularly, one of the connecting points, in particular the first connecting point, might be the connecting point of the tool attachment device and the connecting lever; one of the connecting points, in particular the second (or third) connecting point, might be the connecting point of the boom and the rocking lever of the Z-kinematics; while one of the connecting points, in particular the third (or second) connecting point, might be the connecting point of the tool attachment device and the boom. Using this method, the mechanics of the Z-kinematics can be used particularly versatile. In particular, the mounting space can be reduced and/or the transmission of forces can be increased. Admittedly, this has the disadvantage that the mathematical description becomes more complex. In particular, a case-by-case analysis of different cases have to be considered. It should be noted that the aforementioned "crossing operation characteristics" may not be employed for only one subassembly of the Z-kinematics, but also for two, three times or an even larger number of subassemblies. Further it should be noted that this "crossing operation characteristics" does usually coincide with the presence of one or more dead centre positions in the afore described sense, at least in analogy.

It is further suggested to employ the method in a shovel, a fork, a bucket and/or a grasping device is attachable (attached) to the tool attachment device and/or in that the hydraulic arrangement forms part of a shovel dozer, a wheel loader, a telescopic wheel loader, a teleloader, a backhoe loader, an excavator and/or a forklift truck. In this case, the presently proposed method can show its intrinsic advantages and properties particularly well. For completeness it should be noted that the respective devices can be connected directly to certain parts of the hydraulic arrangement (at least to certain parts of the respective devices). Usually, however, the respective devices are attached to a tool attachment device of the hydraulic arrangement.

Furthermore, it is suggested that the hydraulic arrangement is arranged on a vehicle and/or in that the mounting base is a vehicle chassis and/or the mounting base is preferably fixedly attached to a vehicle chassis. This way, the presently suggested method can show its intrinsic advantages particularly well.

Furthermore, it is suggested that the input control command is supplied by a human operator. The human operator might be sitting in and/or on the machinery, or might operate the machinery via a remote control. A combination of human control and autonomous driving may be employed in particular in case of a remote control arrangement, where the human operator possibly indicates only the destination or certain aspects of the driving path, while the autonomous driving logic fills in the "missing" command.

It is further suggested to perform the method in a way that the control commands are influenced by at least a sensor signal, in particular a position sensor signal and/or an angle sensor signal. Although the main corrective function—as previously described—is essentially based on a mathematical model of the hydraulic arrangement, a check and/or a fine tuning (improved corrective action) can be performed if at least a sensor signal is used as an additional input. In particular, the sensor signal can be the output of a positional sensor and/or of an angle detecting sensor that is preferably measuring certain aspects of the hydraulic arrangement, like position, relative placement and the like. This may relate to a direct and/or an indirect measurement of the attitude of the tool attachment device and/or the attitude of the attached tool. Nevertheless, additional (a plurality) of sensors (position sensors/angle sensors) can be employed as well for all/a variety/some/several of the various parts of the hydraulic arrangement. This information can be used to gain some information about the current position of the respective parts relative to each other, which can form an input for the mathematical model of the hydraulic arrangement that is used for performing the corrective action. As an example, if the hydraulic arrangement is in a certain position, a lifting command of a certain size might require a different corrective action of the tilting hydraulic piston, as opposed to a different, second position of the hydraulic arrangement.

In particular, the method can be employed in a way that the Z-kinematics comprises a rocking lever and a connecting lever, where the rocking lever is pivotably attached to the boom at a middle section, to the tilting hydraulic piston at a first end section, and to the connecting lever at the second end section thereof; and wherein the connecting lever is connected to the rocking lever at a first end section and to the tool attachment device at the second end section thereof. This is a typical design for a Z-kinematics. In particular, for such an arrangement, the presently proposed method can show its intrinsic advantages and features particularly well.

Furthermore, it is suggested to employ the method in a way, that an angle $\phi_1$ between the line OE, connecting points O and E, and the line EJ, connecting points E and J is calculated using the formula $$\phi_1 = \cos^{-1}\left(\frac{|JE|^2 + |OE|^2 - |OJ|^2}{2 \cdot |JE| \cdot |OE|}\right),$$

where O is the hinging point of the boom and the mounting base, E is the hinging point of the boom and the tool attachment device, and J is the hinging point of the connecting lever of the Z-kinematics and the tool attachment device. This way, the mathematical model can be easily realised and/or an advantageous corrective action can be employed.

Similarly, it is suggested to employ the method in a way, that an angle $\phi_2$ between the line OJ, connecting points O and J, and the line EJ, connecting points E and J is calculated using the formula $$\phi_2 = \cos^{-1}\left(\frac{|OJ|^2 + |JE|^2 - |OE|^2}{2 \cdot |OJ| \cdot |JE|}\right),$$

where O is the hinging point of the boom and the mounting base, E is the hinging point of the boom and the tool attachment device, and J is the hinging point of the connecting lever of the Z-kinematics and the tool attachment device. This way, the mathematical model can be easily realised and/or an advantageous corrective action can be employed.

Even further, it is suggested to employ the method in a way, that an angle $\phi_3$ between the line OJ, connecting points O and J, and the line OE, connecting points O and E is calculated using the formula $$\phi_3 = \cos^{-1}\left(\frac{|OJ|^2 + |OE|^2 - |JE|^2}{2 \cdot |OJ| \cdot |OE|}\right),$$

where O is the hinging point of the boom and the mounting base, E is the hinging point of the boom and the tool attachment device, and J is the hinging point of the connecting lever of the Z-kinematics and the tool attachment device. This way, the mathematical model can be easily realised and/or an advantageous corrective action can be employed.

Further, it is suggested that the compensation command is limited, in particular with respect to its magnitude and/or to its range. Additionally and/or alternatively it is suggested that the compensation command is amplified, in particular with respect to its magnitude. In particular, the compensation can be limited to a certain fraction of the full compensation, for example, to up to/at most/to at least (possibly including or excluding) 90%, 80%, 70%, 60%, 50%, 40%, 30%, 20% or 10%. On the contrary, it might be helpful as well to use an overcompensation, for example of up to/at least (possibly including or excluding) 110%, 120%, 130%, 140%, 150%, 160%, 170%, 180%, 190%, 200%, 250%, 300%, 350%, 400%, 450% or 500%. The amount might be chosen by the manufacturer, by a servicing mechanics, by the employer and/or by the operator himself. In particular it is to be noted that a person who is accustomed to compensate for any attitude change by applying an appropriate corrective signal manually, might be irritated by the presently proposed method, showing an automatic compensation behaviour. Therefore, the operator might be surprised and/or the presently proposed method might be even counterproductive for him (in particular, if a "full" compensation is performed). Using an individually selectable percentage of compensation might be helpful to fade out the manual corrective behaviour of present-day skilled operators. Additionally and/or alternatively, it might be possible that the amount of the at least partial compensation might depend on certain ranges of movement. Therefore, compensation may be realised for a certain range of movements, while no compensation is performed anymore (or a compensation at reduced level is performed) when this range is left. This can be done based on whatever consideration, for example based on considerations with respect to the mechanical ability of performing movements of the hydraulic arrangement.

Further, a controller device is suggested that is designed and arranged to perform a method according to the previous suggestions. The respective controller device may be modified in the previously described sense as well. Usually, such a controller device will show the same advantages and effects, as previously described, at least in analogy. In particular, the controller device can be an electronic controller device.

Furthermore, a hydraulic arrangement is suggested that comprises a Z-kinematics and a boom, and that further comprises a plurality of hydraulic actuators, in particular, at least a tilting hydraulic piston and at least a lifting hydraulic piston, and a controller device of the aforementioned type. This way, the actuated arrangement can show the same advantages and effects, as previously described, at least in analogy. Furthermore, the actuated arrangement can be modified in the previously described sense as well, at least in analogy.

Even further, a working vehicle is suggested that comprises a hydraulic arrangement according to the aforementioned type. This way, the resulting working vehicle can show the aforementioned effects and advantages, at least in analogy. Also, the working vehicle can be modified in the previously described sense as well, at least in analogy.

BRIEF DESCRIPTION OF THE DRAWINGS

Further advantages, features, and objects of the invention will be apparent from the following detailed description of the invention in conjunction with the associated drawings, wherein the drawings show.

DETAILED DESCRIPTION

Figure 1:
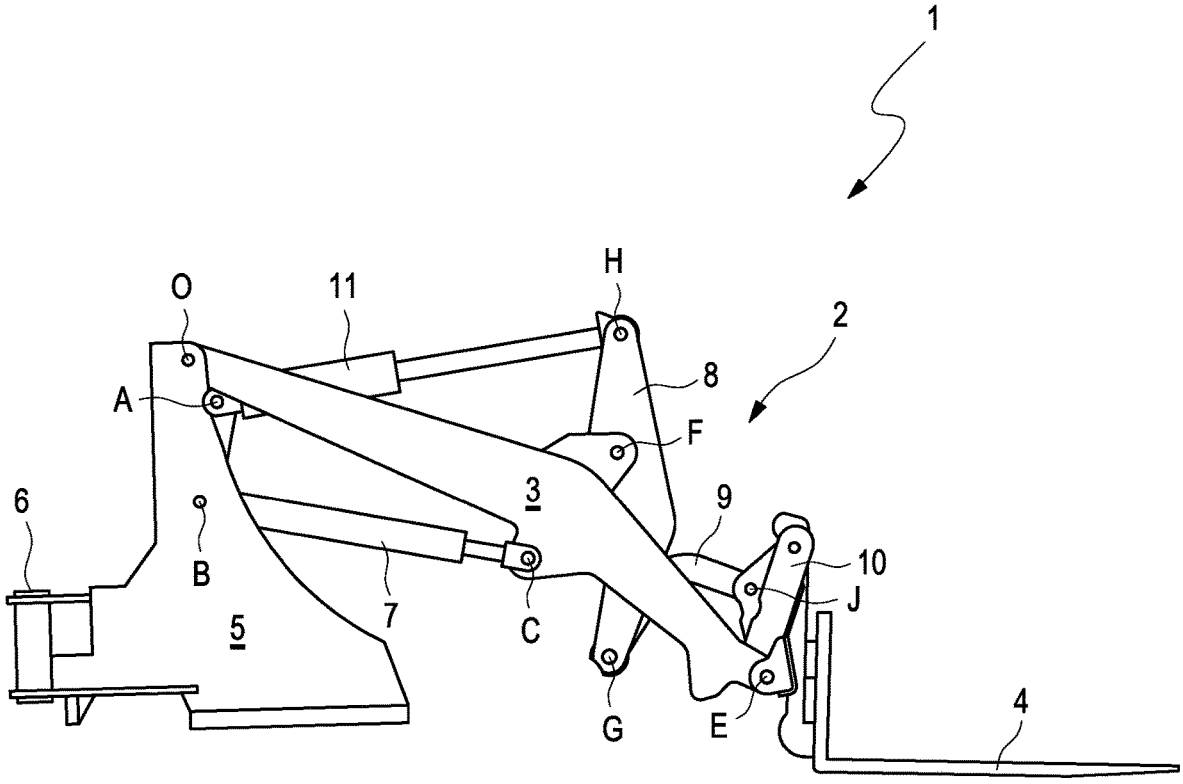
FIG. 1: an embodiment of a kinematics for a wheel loader in a first position.

FIG. 1 shows a kinematics 1, comprising a Z-kinematics 2 for a wheel loader (not shown) in a first position. In the position shown in FIG. 1, the kinematics 1 is shown in a low position of the boom 3 with a horizontal attitude of the fork 4.

Figure 5:
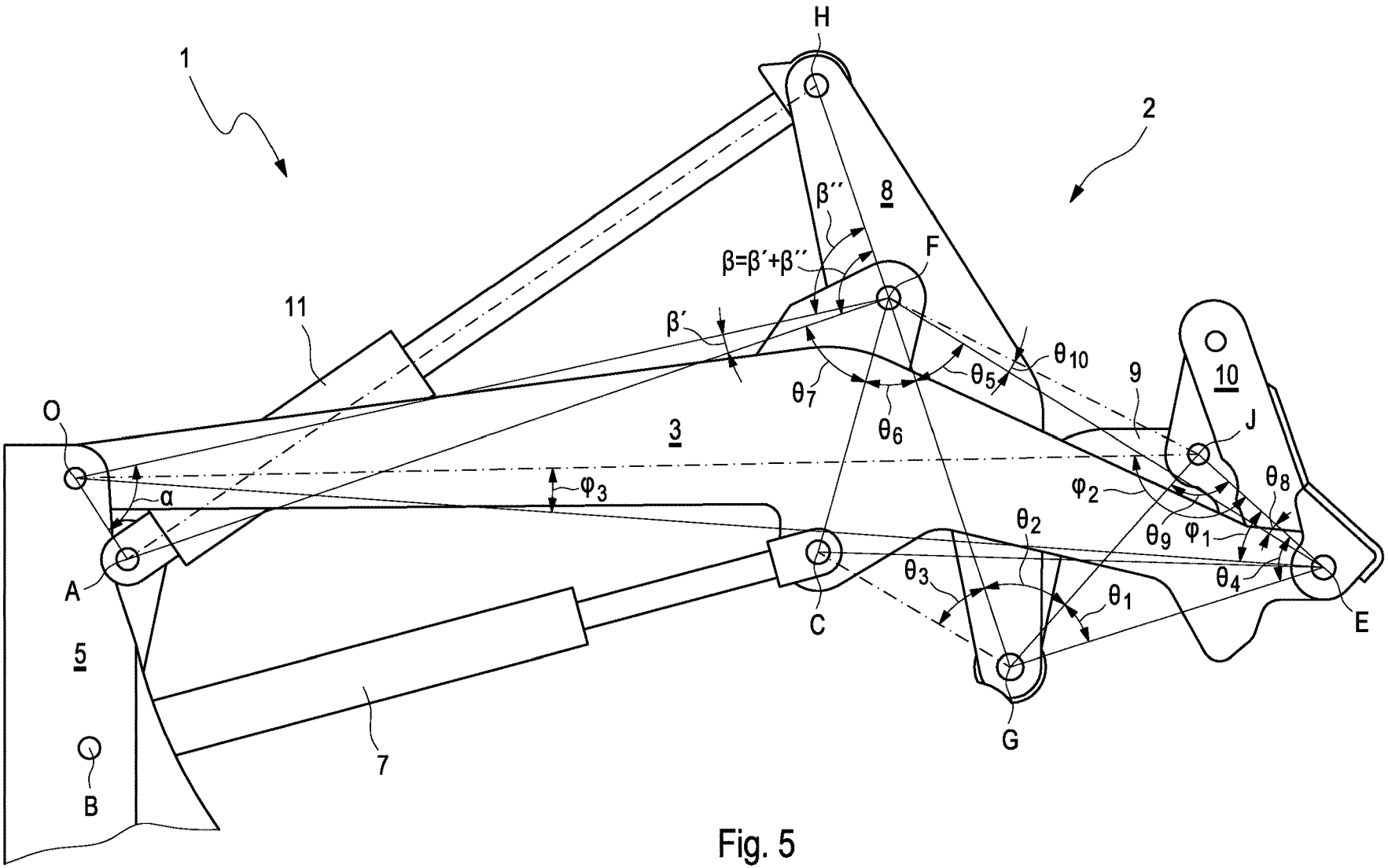
FIG. 5: various definitions of parts, angles, lines and connections of the kinematics according to FIGS. 1 to 3.

As it is known in the state of the art as such, the kinematics 1 comprises a boom 3 that is pivotally mounted to the mounting base 5 of the kinematics 1 at hinge point O (see FIG. 5). The mounting base 5 is presently designed to be connected to a vehicle chassis (presently not shown) via a hinge 6 with a vertical axis. This way, the kinematics 1 can be angularly moved parallel to the ground within a certain range.

The boom 3 can be raised and lowered using a lifting hydraulic piston 7. The hydraulic lifting piston 7 is pivotably connected with one of its end sections to the mounting base 5 at point B (see FIG. 5). With its other end section, the lifting hydraulic piston 7 is pivotably connected to the boom 3 at point C.

Further, attached to the boom 3, there is a Z-kinematics 2, comprising a rocking lever 8. The rocking lever 8 is rotatably connected to the boom 3 at point F. As can be easily seen from the FIGS., point F is located in a middle section of the rocking lever 8, where the position of point F is offset from the exact middle, presently towards point H.

Further, the rocking lever 9 is rotatably connected to a connecting lever 9 at point G. Point G is—as can be easily seen from the FIGS.—located in one of the end sections of connecting levers 9, while the other end section of connecting lever 9 is rotatably connected to tool mount 10 at point J. The tool mount 10 can be used to reversibly connect a tool like a fork 4, a shovel, a bucket and the like.

The Z-kinematics 2 can be actuated by the tilting hydraulic piston 11. The tilting hydraulic piston 11 is connected with one of its end sections to one end of the rocking lever 8 at point H, whereas it is connected with its other end section to the mounting base 5 at point A.

Further, the tool mount 10 is pivotably connected to the boom 3 at point E.

As it is known from the prior art, the boom 3 can be raised or lowered by actuating the lifting hydraulic piston 7, while the tool mount 10 (and consequently the tool attached to it, like a fork 4) can be tilted by an appropriate contraction or expansion of tilting hydraulic piston 11.

Figure 2:
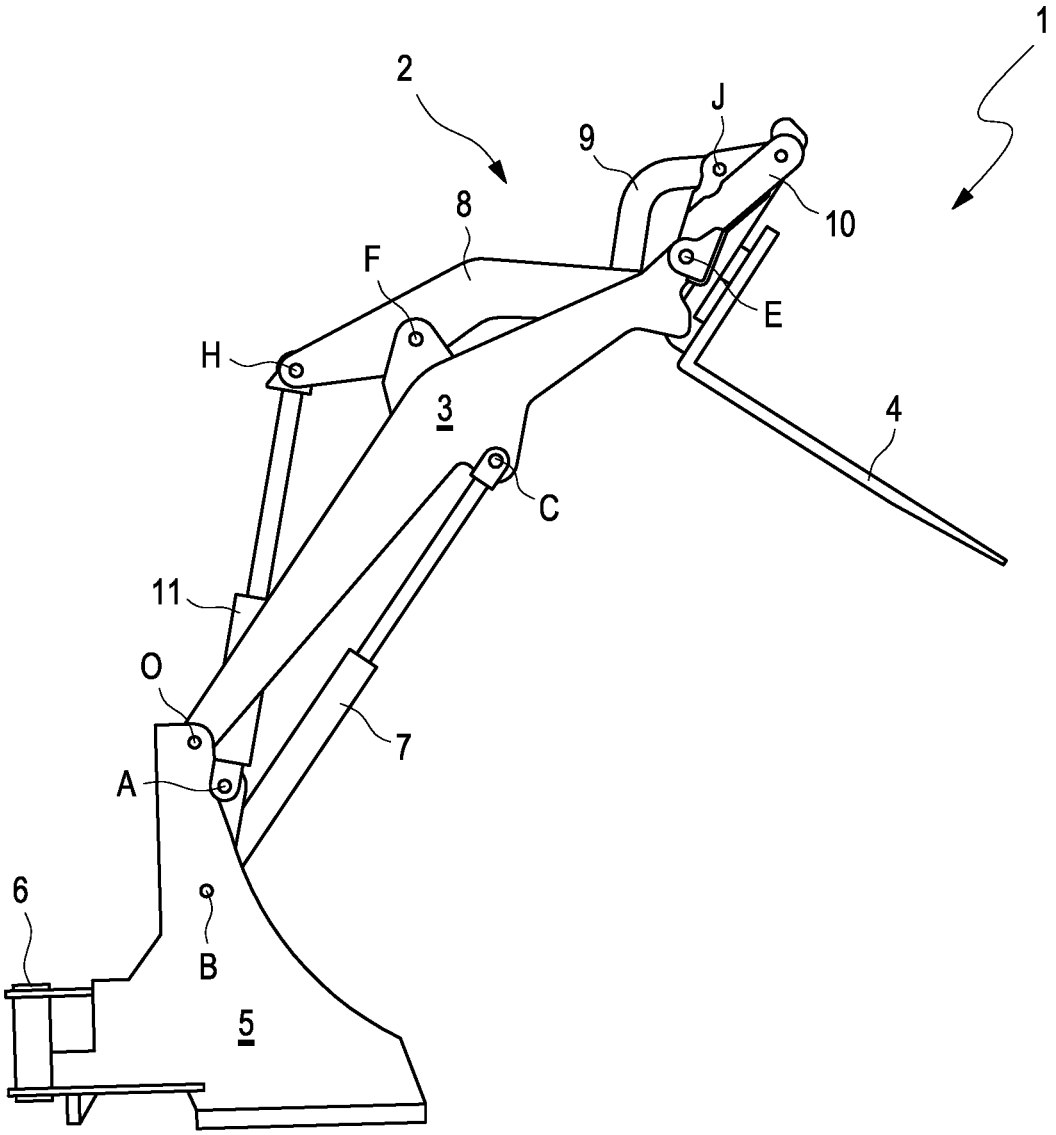
FIG. 2: the embodiment of a kinematics for a wheel loader according to FIG. 1 in a second position.

If the kinematics 1 is to be moved from its lower position, as shown in FIG. 1, to an upper position, as shown in FIG. 2, this lifting movement can be performed by an expanding actuation of the lifting hydraulic piston 7. Based on the very design of the kinematics 1, this induces a certain problem. Namely, the lifting movement induced by the lifting hydraulic piston 7 will lead to an attitude change of the fork 4. Presently, the upward movement will lead to a downward tilting of the fork 4, so that the kinematics 1 will end up in the position shown in FIG. 2.

Figure 3:
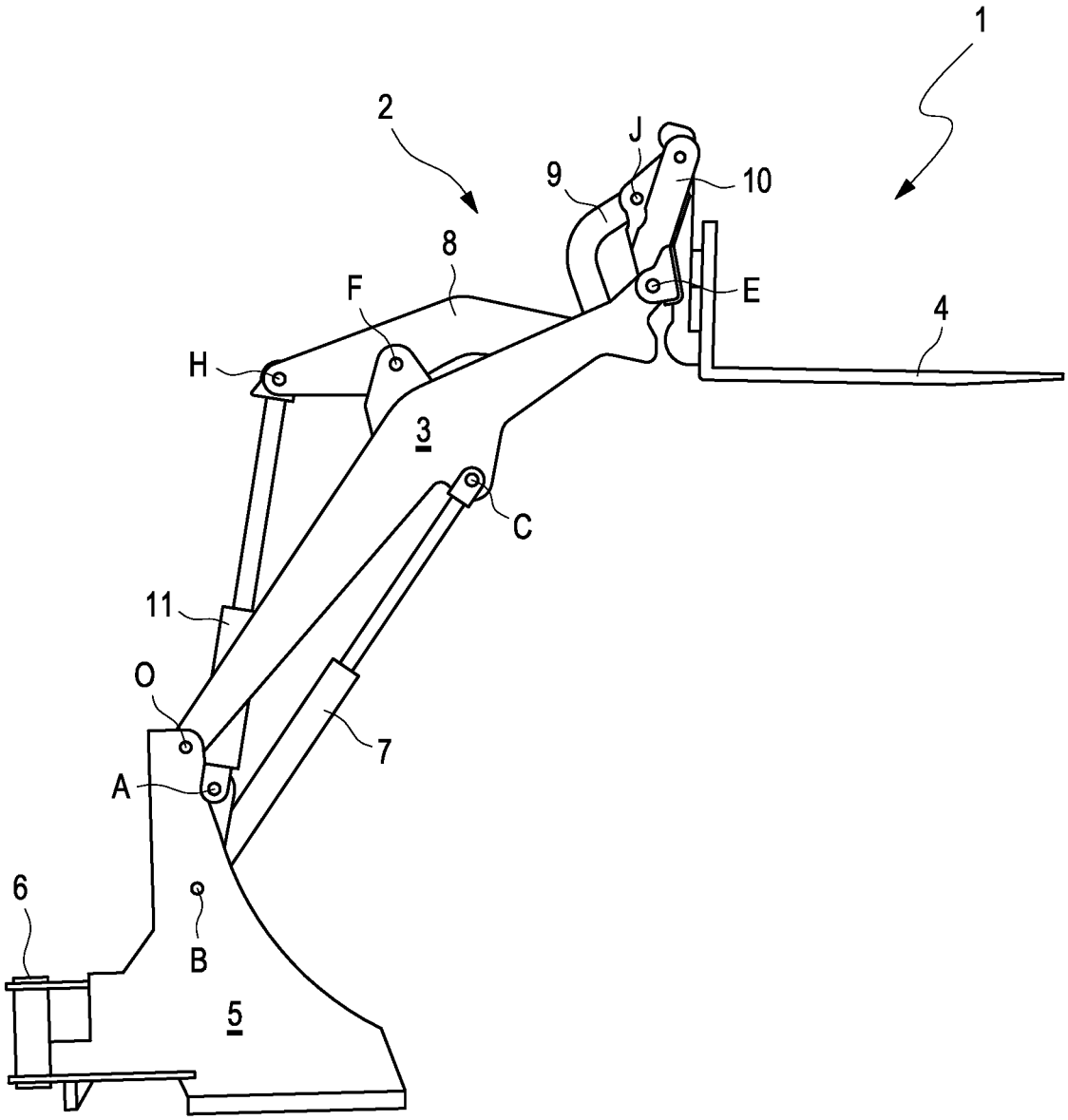
FIG. 3: the kinematics of a wheel loader according to FIG. 1 in a third position.

To avoid this effect, which incurs the possibility that goods (not shown) that are loaded on the fork 4 will fall off the fork when the fork 4 is raised, according to the present disclosure a corrective action is applied to the tilting hydraulic piston 11. This correction is applied automatically by a (electronic) controller (for example single printed board programmable controller), when an operator commands a raising or lowering action. Therefore, in addition to a simple actuation of the lifting hydraulic piston 7, the controller will additionally command an appropriate actuation of the tilting hydraulic piston 11. This way, a lifting actuation with corrections applied will lead to the final position according to FIG. 3: the fork 4 remains in the horizontal position, although the operator manually commands an expansion of the lifting hydraulic piston 7 only.

For the controller to be able to calculate an appropriate corrective actuation, the controller requires information about the present position of the kinematics 1, in addition to the applied control commands by the operator.

In the presently shown embodiment, two angle detectors are used for this purpose. The two sensors (not shown) are placed in point F and point O, respectively. They are used to measure angle $\alpha$ (which is the angle between the lines OA and OF), and the angle $\beta$ (which is the angle between the lines AF and HF).

It is to be noted that this is just one possible embodiment. (In part) additionally and/or (in part) alternatively, angle detectors may be employed at other positions and/or position detectors, in particular for measuring the position of hydraulic pistons 7, 11 or the like, may be used.

Figure 4:
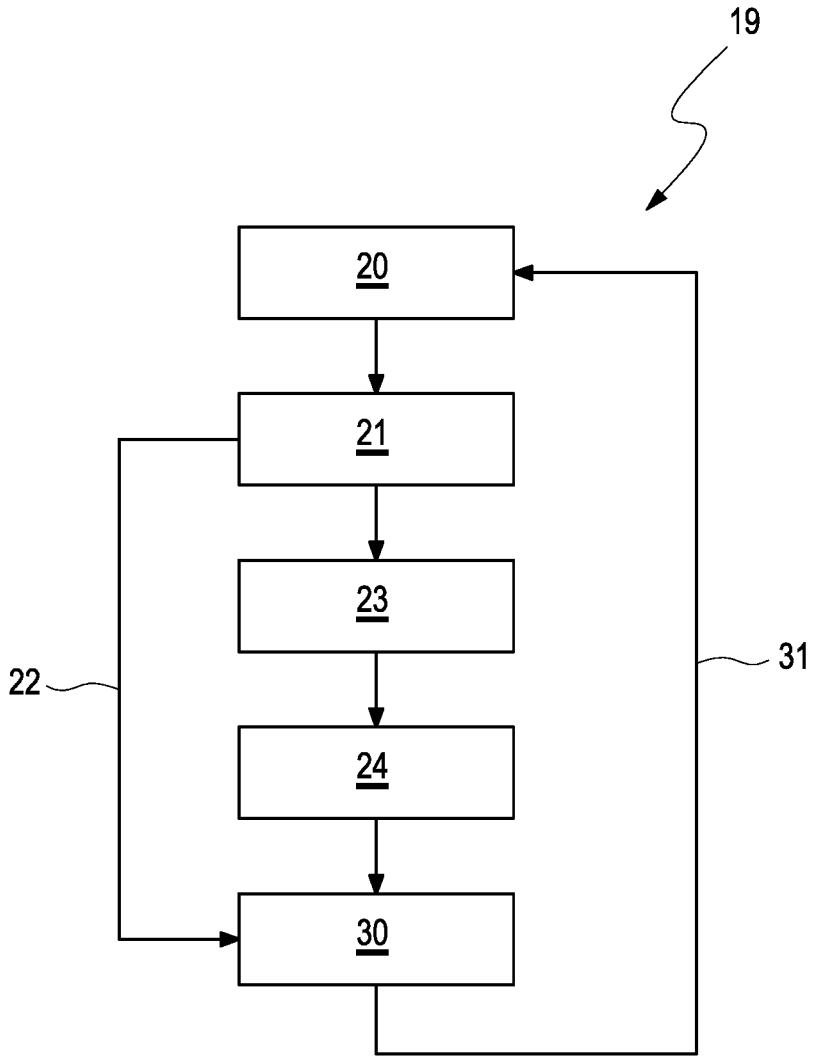
FIG. 4: a flowchart, illustrating a possible method to actuate a hydraulic kinematics.

FIG. 4 shows a basic flowchart 19 of the method to be performed. A controller checks 20 for an input by the operator. If an input is detected, the controller checks for the nature of the command. If an actuation of the tilting hydraulic piston 11 it is commanded, the algorithm jumps 22 directly to step 30, where the command is applied to the appropriate actuators, presently to tilting hydraulic piston 11.

If a lifting or lowering command is applied, however, the algorithm jumps to step 23, were sensor data by the angle/position sensors is read in.

Using the positional data and the input command (actuation of lifting hydraulic piston 7), a corrective command 24 is calculated (presently for the tilting hydraulic piston 11). Both commands, i.e. the input command and the correcting command will be handed over to step 30 and applied to the respective hydraulic pistons 7, 11. Afterwards, the algorithm jumps back 31 and repeats.

The mathematical model that is used for calculating the corrective signal in step 24 of the flowchart 19 is further elucidated by the following equations which refer to the notation illustrated in FIG. 5 in the following. Further, the notation is used that BC denotes the line between points B and C (similar for other points). Further, in the following the cosine rule for the general triangle (non-rectangular triangle) will be used frequently. Further, as it will be obvious to a person skilled in the art, several distances are defined by the mechanical setup of the actuated arrangement, while others will change. In particular, the lengths of the hydraulic pistons 7, 11 are subject to variations. Please also keep in mind that in the presently described embodiment the angles α, β are measured using angular sensors. Certainly, the method can be easily modified if different sensors are used.

We have the identity β=β'+β", with β being measured and $$\beta' = \cos^{-1}\left(\frac{|AF|^2 + |OF|^2 - |AO|^2}{2\cdot|AF|\cdot|OF|}\right).$$

Using $$\theta_5 = \cos^{-1}\left(\frac{|FC|^2 + |EF|^2 - |CE|^2}{2\cdot|FC|\cdot|EF|}\right) - \theta_6,$$

and assuming that the points H, F and G are arranged directly in line, we can use $\theta_6=\pi-(\theta_7+\beta)$, getting $$\theta_7 = \cos^{-1}\left(\frac{|FC|^2 + |FO|^2 - |OC|^2}{2\cdot|FC|\cdot|FO|}\right) - \beta''.$$

Knowing these angles, |GE| can be calculated to be $$|GE| = \sqrt{|EF|^2 + |FG|^2 - 2\cdot|EF|\cdot|FG|\cdot\cos(\theta_5)}.$$

Since all sides in triangle ΔFGE are known, the remaining angles in the triangle can be calculated.

$$\theta_1 + \theta_2 = \cos^{-1}\left(\frac{|GE|^2 + |FG|^2 - |FE|^2}{2\cdot|GE|\cdot|FG|}\right),$$

$$\theta_8 + \theta_4 = \cos^{-1}\left(\frac{|JE|^2 + |GE|^2 - |JG|^2}{2\cdot|JE|\cdot|GE|}\right),$$

$$\theta_1 = \cos^{-1}\left(\frac{|JG|^2 + |GE|^2 - |JE|^2}{2\cdot|JG|\cdot|GE|}\right).$$

Therefore, $\theta_2$ can be determined. In the following, we have to consider two different cases, since triangle ΔFJE flips at a certain point. Therefore, |OJ| must be calculated using two different cases:

For β≤49.505:

$$\text{For } \beta \le 49.505\text{: } \theta_2 = \cos^{-1}\left(\frac{|GE|^2 + |FG|^2 - |FE|^2}{2\cdot|GE|\cdot|FG|}\right) + \theta_1,$$

and $$\text{for } \beta \le 49.505\text{: } \theta_2 = \cos^{-1}\left(\frac{|GE|^2 + |FG|^2 - |FE|^2}{2\cdot|GE|\cdot|FG|}\right) - \theta_1\cdot d$$

and for β>49.505:

$$|FJ| = \sqrt{|JG|^2 + |FG|^2 - 2\cdot|JG|\cdot|FG|\cdot\cos(\theta_2)}.$$

Consequently, $|FJ|=\sqrt{|JG|^2+\equiv FG|^2-2\cdot|JG|\cdot|FG|\cdot\cos(\theta_2)}$.

Knowing |FJ| we can now calculate $\theta_{10}$ using the equation $$\theta_{10} = \cos^{-1}\left(\frac{|FJ|^2 + |FE|^2 - |JE|^2}{2\cdot|FJ|\cdot|EF|}\right).$$

Again, due to the fact that triangle ΔFJG flips at a certain point, for calculating |OJ| two cases have to be considered:

$$\text{For } \beta \ge 95:$$

$$|OJ| = \sqrt{|OF|^2 + |FJ|^2 - 2\cdot|OF|\cdot|FJ|\cdot\cos(\beta' + \theta_7 + \theta_6 + \theta_5 - \theta_{10})},$$

and $$\text{for } \beta > 95:$$

$$|OJ| = \sqrt{|OF|^2 + |FJ|^2 - 2\cdot|OF|\cdot|FJ|\cdot\cos(\beta' + \theta_7 + \theta_6 + \theta_5 + \theta_{10})}.$$

Hence, it is possible to determine all angles inside triangle ΔOEJ using:

$$\phi_1 = \cos^{-1}\left(\frac{|JE|^2 + |OE|^2 - |OJ|^2}{2\cdot|JE|\cdot|OE|}\right)$$

$$\phi_2 = \cos^{-1}\left(\frac{|OJ|^2 + |JE|^2 - |OE|^2}{2\cdot|OJ|\cdot|JE|}\right)$$

$$\phi_3 = \cos^{-1}\left(\frac{|OJ|^2 + |OE|^2 - |JE|^2}{2\cdot|OJ|\cdot|OE|}\right).$$

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method of operating a hydraulic arrangement comprising a mounting base, a boom that is pivotably arranged on the mounting base, and a Z-kinematics that is arranged on the boom, the Z-kinematics being designed and arranged to tilt a tool attachment device, the tool attachment device being pivotably arranged on the boom, wherein the boom is moved by at least a lifting hydraulic piston that is connected to the boom and to the mounting base, and wherein the Z-kinematics is moved by at least a tilting hydraulic piston that is connected to a lever of the Z-kinematics and to the mounting base, wherein on application of an input control command for changing the position of the lifting hydraulic piston, an initial compensation command is automatically generated and applied to the tilting hydraulic piston, to essentially maintain the attitude of the tool attachment device, where the initial compensation command is generated based on the input control command for the lifting hydraulic piston, using a mathematical model of the hydraulic arrangement and without using input from an angle sensor associated with the tool attachment device.

2. The method according to claim 1, wherein the Z-kinematics is operated on different sides of a dead centre position thereof.

3. The method according to claim 2, wherein the Z-kinematics may be moved across and/or may be operated on both sides of a straight line that is defined by a second and a third connecting point of parts of the Z-kinematics.

4. The method according to claim 2, wherein a bucket, a fork, a shovel and/or a grasping device is attachable to the tool attachment device and/or in that the hydraulic arrangement forms part of a shovel dozer, a wheel loader, a telescopic wheel loader, a teleloader, a backhoe loader, an excavator and/or a forklift truck.

5. The method according to claim 2, wherein the hydraulic arrangement is arranged on a vehicle and/or in that the mounting base is a vehicle chassis and/or the mounting base is preferably fixedly attached to a vehicle chassis.

6. The method according to claim 1, wherein the Z-kinematics is operated in a way that a first connecting point of parts of the Z-kinematics may be moved across and/or may be operated on both sides of a straight line that is defined by a second and a third connecting point of parts of the Z-kinematics.

7. The method according to claim 6, wherein a bucket, a fork, a shovel and/or a grasping device is attachable to the tool attachment device and/or in that the hydraulic arrangement forms part of a shovel dozer, a wheel loader, a telescopic wheel loader, a teleloader, a backhoe loader, an excavator and/or a forklift truck.

8. The method according to claim 6, wherein the hydraulic arrangement is arranged on a vehicle and/or in that the mounting base is a vehicle chassis and/or the mounting base is preferably fixedly attached to a vehicle chassis.

9. The method according to claim 1, wherein a bucket, a fork, a shovel and/or a grasping device is attachable to the tool attachment device and/or in that the hydraulic arrangement forms part of a shovel dozer, a wheel loader, a telescopic wheel loader, a teleloader, a backhoe loader, an excavator and/or a forklift truck.

10. The method according to claim 1, wherein the hydraulic arrangement is arranged on a vehicle and/or in that the mounting base is a vehicle chassis and/or the mounting base is fixedly attached to a vehicle chassis.

11. The method according to claim 1, wherein the input control command is applied by a human operator.

12. The method according to claim 1, wherein an improved compensation command which is influenced by at least one sensor signal, wherein the at least one sensor signal includes a position sensor signal and/or an angle sensor signal, is subsequently generated.

13. The method according to claim 1, wherein the Z-kinematics comprises a rocking lever and a connecting lever, where the rocking lever is pivotably attached to the boom at a middle section, to the tilting hydraulic piston at a first end section, and to the connecting lever at a second end section thereof; and wherein the connecting lever is connected to the rocking lever at a first end section and to the tool attachment device at a second end section thereof.

14. The method according to claim 1, wherein the compensation command is limited with respect to its magnitude and/or to its range and/or in that the compensation command is amplified with respect to its magnitude.

15. A controller device, wherein the controller device is an electronic controller device that is designed and arranged to perform a method according to claim 1.

16. A hydraulic arrangement, comprising a Z-kinematics and a boom, and further comprising a plurality of hydraulic actuators, wherein at least one of said plurality of hydraulic actuators is a tilting hydraulic piston and at least one of said plurality of hydraulic actuators is a lifting hydraulic piston, and the controller device according to claim 15.

17. A working vehicle, comprising a hydraulic arrangement according to claim 16.

18. A method of operating a hydraulic arrangement comprising a mounting base, a boom that is pivotably arranged on the mounting base, and a Z-kinematics that is arranged on the boom, the Z-kinematics being designed and arranged to tilt a tool attachment device, the tool attachment device being pivotably arranged on the boom, wherein the boom is moved by at least a lifting hydraulic piston that is connected to the boom and to the mounting base, and wherein the Z-kinematics is moved by at least a tilting hydraulic piston that is connected to a lever of the Z-kinematics and to the mounting base, wherein on application of an input control command for changing the position of the lifting hydraulic piston, a compensation command is automatically generated and applied to the tilting hydraulic piston, to essentially maintain the attitude of the tool attachment device, where the compensation command is generated based on the input control command for the lifting hydraulic piston, using a mathematical model of the hydraulic arrangement, wherein the Z-kinematics comprises a rocking lever and a connecting lever, where the rocking lever is pivotably attached to the boom at a middle section, to the tilting hydraulic piston at a first end section, and to the connecting lever at a second end section thereof; and wherein the connecting lever is connected to the rocking lever at a first end section and to the tool attachment device at a second end section thereof, wherein the method calculates an angle $\phi_1$ between a line OE, connecting points O and E, and a line Ej, connecting points E and J, using a formula $$\phi_1 = \cos^{-1}\left(\frac{|JE|^2 + |OE|^2 - |OJ|^2}{2 \cdot |JE| \cdot |OE|}\right),$$

where O is a hinging point of the boom and the mounting base, E is a hinging point of the boom and the tool attachment device, and J is a hinging point of the connecting lever of the Z-kinematics and the tool attachment device.

19. A method of operating a hydraulic arrangement comprising a mounting base, a boom that is pivotably arranged on the mounting base, and a Z-kinematics that is arranged on the boom, the Z-kinematics being designed and arranged to tilt a tool attachment device, the tool attachment device being pivotably arranged on the boom, wherein the boom is moved by at least a lifting hydraulic piston that is connected to the boom and to the mounting base, and wherein the Z-kinematics is moved by at least a tilting hydraulic piston that is connected to a lever of the Z-kinematics and to the mounting base, wherein on application of an input control command for changing the position of the lifting hydraulic piston, a compensation command is automatically generated and applied to the tilting hydraulic piston, to essentially maintain the attitude of the tool attachment device, where the compensation command is generated based on the input control command for the lifting hydraulic piston, using a mathematical model of the hydraulic arrangement, wherein the Z-kinematics comprises a rocking lever and a connecting lever, where the rocking lever is pivotably attached to the boom at a middle section, to the tilting hydraulic piston at a first end section, and to the connecting lever at a second end section thereof; and wherein the connecting lever is connected to the rocking lever at a first end section and to the tool attachment device at a second end section thereof, wherein the method calculates an angle $\phi_2$ between a line OJ, connecting points O and J, and a line EJ, connecting points E and J, using a formula $$\phi_2 = \cos^{-1}\left(\frac{|OJ|^2 + |JE|^2 - |OE|^2}{2 \cdot |OJ| \cdot |JE|}\right),$$

where O is a hinging point of the boom and the mounting base, E is a hinging point of the boom and the tool attachment device, and J is a hinging point of the connecting lever of the Z-kinematics and the tool attachment device.

20. A method of operating a hydraulic arrangement comprising a mounting base, a boom that is pivotably arranged on the mounting base, and a Z-kinematics that is arranged on the boom, the Z-kinematics being designed and arranged to tilt a tool attachment device, the tool attachment device being pivotably arranged on the boom, wherein the boom is moved by at least a lifting hydraulic piston that is connected to the boom and to the mounting base, and wherein the Z-kinematics is moved by at least a tilting hydraulic piston that is connected to a lever of the Z-kinematics and to the mounting base, wherein on application of an input control command for changing the position of the lifting hydraulic piston, a compensation command is automatically generated and applied to the tilting hydraulic piston, to essentially maintain the attitude of the tool attachment device, where the compensation command is generated based on the input control command for the lifting hydraulic piston, using a mathematical model of the hydraulic arrangement, wherein the Z-kinematics comprises a rocking lever and a connecting lever, where the rocking lever is pivotably attached to the boom at a middle section, to the tilting hydraulic piston at a first end section, and to the connecting lever at a second end section thereof; and wherein the connecting lever is connected to the rocking lever at a first end section and to the tool attachment device at a second end section thereof, wherein the method calculates an angle $\phi_3$ between a line OJ, connecting points O and J, and a line OE, connecting points O and E, using a formula $$\phi_3 = \cos^{-1}\left(\frac{|OJ|^2 + |OE|^2 - |JE|^2}{2 \cdot |OJ| \cdot |OE|}\right),$$

where O is a hinging point of the boom and the mounting base, E is a hinging point of the boom and the tool attachment device, and J is a hinging point of the connecting lever of the Z-kinematics and the tool attachment device.

* * * * *